US009572391B2

(12) United States Patent
McInnis et al.

(10) Patent No.: US 9,572,391 B2
(45) Date of Patent: Feb. 21, 2017

(54) PROTECTIVE HELMET AND INSERT WITH CONCUSSION REDUCTION FEATURES

(76) Inventors: Daniel Malcolm McInnis, Ottawa (CA); Rodney Mark McInnis, Ottawa (CA)

( * ) Notice: Subject to any disclaimer, the term of this patent is extended or adjusted under 35 U.S.C. 154(b) by 865 days.

(21) Appl. No.: 13/436,048

(22) Filed: Mar. 30, 2012

(65) Prior Publication Data

US 2013/0254978 A1 Oct. 3, 2013

(51) Int. Cl.
*A42B 3/12* (2006.01)
*A42B 3/28* (2006.01)
*A42B 3/06* (2006.01)

(52) U.S. Cl.
CPC ..... *A42B 3/124* (2013.01); *A42B 3/064* (2013.01); *A42B 3/28* (2013.01)

(58) Field of Classification Search
CPC ..... A42B 3/064; A42B 3/28; A42B 3/124
USPC ..... 2/410–416, 421, 425
See application file for complete search history.

(56) References Cited

U.S. PATENT DOCUMENTS 4,290,149 A * 9/1981 Aileo ..... A42C 2/007 2/414
5,231,703 A 8/1993 Garneau
5,309,576 A * 5/1994 Broersma ..... 2/412
5,571,220 A * 11/1996 Hall ..... 2/424
5,734,994 A 4/1998 Rogers
6,070,271 A * 6/2000 Williams ..... 2/412
6,321,386 B1 11/2001 Monica
6,453,476 B1 * 9/2002 Moore, III ..... 2/412
6,560,787 B2 * 5/2003 Mendoza ..... 2/413
6,704,943 B2 3/2004 Calonge Clavell
7,299,505 B2 11/2007 Dennis et al.
7,958,573 B2 6/2011 Lewis, Jr. et al.
2007/0119538 A1 5/2007 Price et al.
2008/0009556 A1 * 1/2008 Schneider ..... C08G 18/10 521/128

* cited by examiner

*Primary Examiner* — Katherine Moran
(74) *Attorney, Agent, or Firm* — Osha Liang LLP

(57) ABSTRACT

A protective helmet and insert for reducing the possibility or severity of a concussion are provided. The insert comprises a shock absorbing portion and a flexible liner portion, the shock absorbing portion to be disposed between a helmet shell and the liner portion. The shock absorbing portion can possess a substantially constant resistive deformation force characteristic for reducing the peak G-force applied to the head during an impact. The insert can comprise a plurality of flexible liner connectors for movably interconnecting the liner portion to a helmet shell to allow for the flexible movement of the liner portion relative the shell. The liner connectors can be in the form of vent shaft walls that each defines a vent shaft for providing fluid communication between a headspace of the liner and an outer side of the shock absorbing portion to ventilate the headspace. A helmet comprising the liner is also provided.

15 Claims, 12 Drawing Sheets

PROTECTIVE HELMET AND INSERT WITH CONCUSSION REDUCTION FEATURES

FIELD OF THE DISCLOSURE

The present disclosure relates generally to protective equipment, and more particularly to helmets and helmet components.

BACKGROUND

Protective helmets are known in the art. Many different types of protective helmets exist for various applications, including for playing sports, riding on or in vehicles, for use in dangerous environments such as construction sites, to name but a few. In certain types of activities, there is a significant risk of a person receiving a blow to the head or otherwise hitting their head. These activities include but are not limited to ice hockey, downhill skiing, snowboarding, and skateboarding.

Many existing helmets generally do a good job in reducing or preventing cuts and fractures to the head and skull as a result of an impact to the head.

Many existing helmet designs utilize various foams for structure and for absorbing energy during an impact. Some helmets use small patches of foam, including memory foam, for comfort and fit. For example, memory foam is sometimes positioned within the helmet so that it contacts or is in close proximity to the head of a wearer. The memory foam can provide for a comfortable and snug fit of the helmet. The body heat from the head warms the memory foam, thereby softening it, which makes for a more comfortable and snug fit.

In addition, many existing helmets, including hockey helmets, are fairly rigid in their construction and are also designed to be snuggly fitted and rigidly coupled to the head. The result is that a high proportion of an impact force, particularly a rotational impact force, is transmitted by the helmet to the head of the wearer. In other words, the helmet absorbs little or none of a rotational impact force.

Furthermore, many existing helmets are ventilated to keep the head cool and the wearer comfortable.

However, most helmets are not very effective in preventing concussions, in reducing the severity of concussions, or in preventing or reducing other injuries such as spinal injuries. In normal impacts as might be expected in a sport, existing helmets, while reducing G-force experienced by the head, still permit G-forces to be at unacceptable and dangerously high levels.

SUMMARY

The present disclosure provides a helmet, a helmet insert, and techniques that provide for increased protection against concussions, spinal injuries and other types of injuries.

For example, the present disclosure provides a helmet and helmet insert that utilizes as its primary shock absorber a shock absorbing portion having a substantially constant resistive deformation force characteristic. A constant force characteristic refers to the relatively constant resistive deformation force exhibited by the material during an impact. What is remarkable is this constant force characteristic is approximately maintained throughout the changing speed of the impact incident. This creates a near-ideal scenario to reduce peak G-force over the compression distance. Thus the resistive deformation force does not significantly increase as the amount of deformation (e.g. compression) increases. This is unlike many other types shock absorbing materials, including many foams, which exhibit a more spring-like resistive deformation force. In these materials, the resistive force increases proportionally to the amount of deformation in the material. This characteristic can result in a very high peak forces to the head and brain during an impact. In contrast, shock absorbing materials that have a relatively constant resistive deformation force characteristic tend to result in lower peak forces being transmitted to the head and brain during an impact. Helmets that comprise a shock absorbing portion having a constant resistive deformation force characteristic can result in lower amounts of linear and/or rotational forces being transferred to the head during an impact.

The present disclosure also provides a helmet having an inner liner that is spaced apart from and is moveably interconnected to its outer shell, thereby allowing the outer shell to move and/or rotate relative the liner, and/or the head of a wearer. Therefore during an impact, some of the linear and/or rotational forces applied to the helmet can be absorbed by the helmet as the outer shell moves and/or rotates relative to the liner or head of the wearer.

The present disclosure further provides a helmet and helmet insert comprising a shock absorbing portion that provides a thicker compression distance relative to existing helmets. For example, in at least one embodiment, the shock absorbing portion is at least 1.5 inches (38 mm) in thickness. In at least one other embodiment, the shock absorbing portion is at least 2 inches (51 mm) in thickness.

The present disclosure also provides a helmet and helmet insert comprising a shock absorbing portion wherein the shock absorbing portion is thermally insulated from the head of the wearer.

The present disclosure further provides a helmet and helmet insert comprising a shock absorbing portion wherein the shock absorbing portion is fluidly insulated from the head of the wearer.

In one aspect, the present disclosure provides a helmet insert disposable at an inner side of a shell of a helmet, the insert comprising: a first shock absorbing portion having a structure that is flexible, deformable, compressible, and capable of substantially recovering from a deformation, and further having a structure possessing a substantially constant resistive deformation force characteristic; and a flexible liner portion, the liner portion being disposed at or proximate the first shock absorbing portion, the liner portion having a thickness that is less than a thickness of the first shock absorbing portion, wherein when the insert is disposed in the helmet, the first shock absorbing portion faces an inner surface of the shell, and the liner portion faces a region of the helmet adapted to receive the head of a wearer.

In another aspect, the present disclosure provides a helmet insert disposable at an inner side of a shell of a helmet, the insert comprising: a first shock absorbing portion having a structure that is flexible and deformable, the first shock absorbing portion having an outer side and an inner side; a flexible liner portion, the liner portion being disposed at or proximate the inner side of the first shock absorbing portion; a plurality of spaced apart flexible liner connectors, each liner connector comprising a proximal end connected to or integrally formed with the liner portion, each liner connector further comprising a distal end extending towards the outer side of the first shock absorbing portion, the distal end of each liner connector being connectable to the shell such that when the helmet insert is disposed within the shell, the liner connectors moveably interconnect the liner portion with the shell, thereby allowing for limited and flexible movement of the liner portion relative to the shell.

In yet another aspect, the present disclosure provides a protective helmet having an outer portion, and an inner portion for receiving the head of a wearer, the helmet comprising: an outer shell for circumscribing the head of the wearer; a first shock absorbing portion disposed within the outer shell and having a structure that is flexible and deformable, the first shock absorbing portion having an outer side and an inner side, the outer side facing the outer shell; a flexible liner portion, the liner portion being disposed at or proximate the inner side of the first shock absorbing portion; a plurality of spaced apart flexible liner connectors, each liner connector comprising a proximal end connected to or integrally formed with the liner portion, each liner connector further comprising a distal end extending towards the outer side of the first shock absorbing portion, the distal end of each liner connector being connected to the shell to moveably interconnect the liner portion with the shell, thereby allowing for limited and flexible movement of the liner portion relative to the shell.

BRIEF DESCRIPTION OF THE DRAWINGS

The present disclosure will be better understood having regard to the drawings in which.

DETAILED DESCRIPTION

The various features and components of the present helmet and helmet insert are now described with reference to the Figures.

Figure 1:
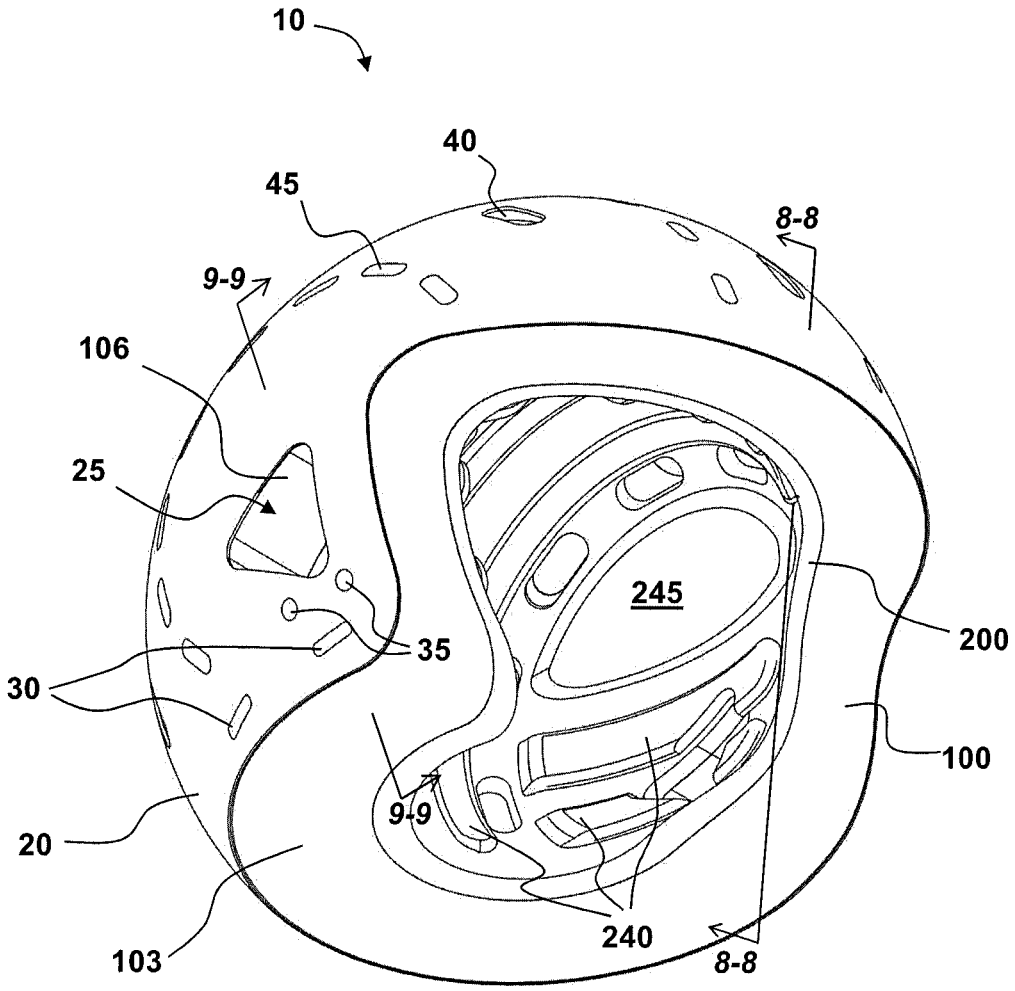
FIG. 1 is a perspective view of a first embodiment of the helmet.
Figure 2:
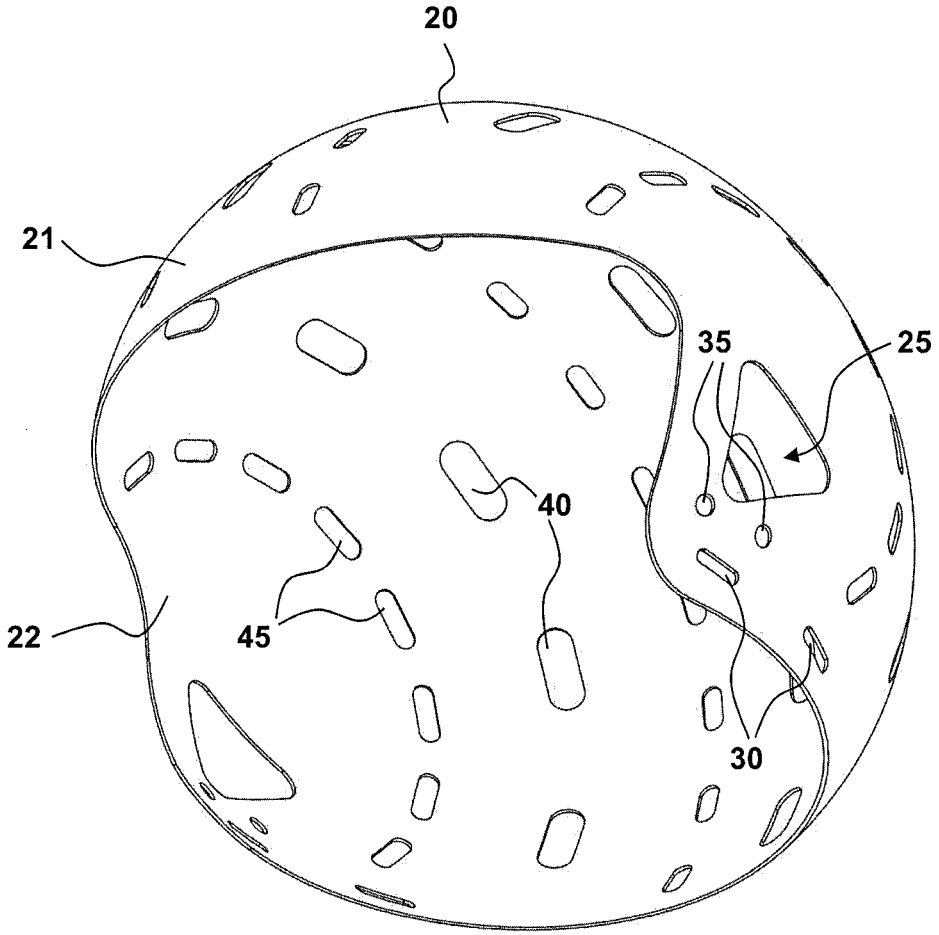
FIG. 2 is a perspective view of the outer shell of the embodiment shown in FIG. 1.
Figure 4:
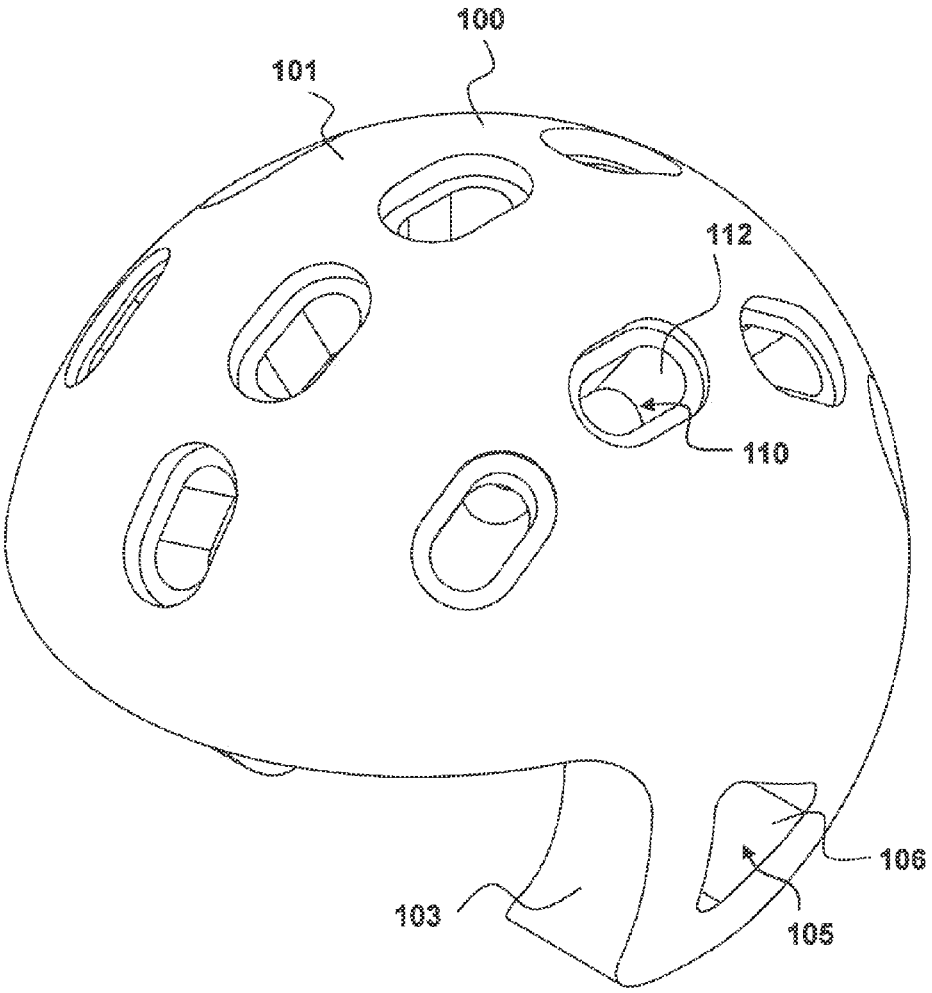
FIG. 4 is a perspective view of the first shock absorbing portion of the embodiment shown in FIG. 1.
Figure 5:
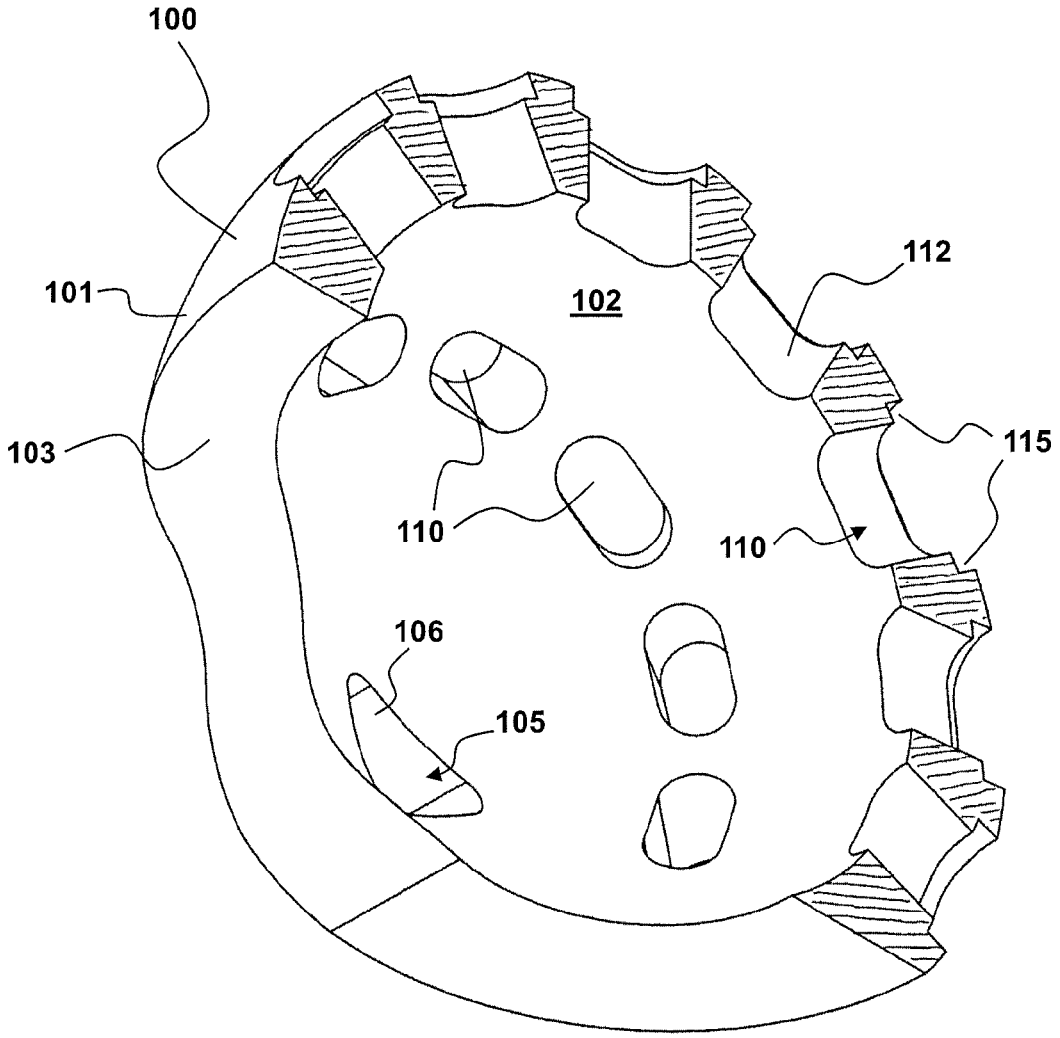
FIG. 5 is a cross sectional view of the first shock absorbing portion taken along line 5-5 of FIG. 4.
Figure 6:
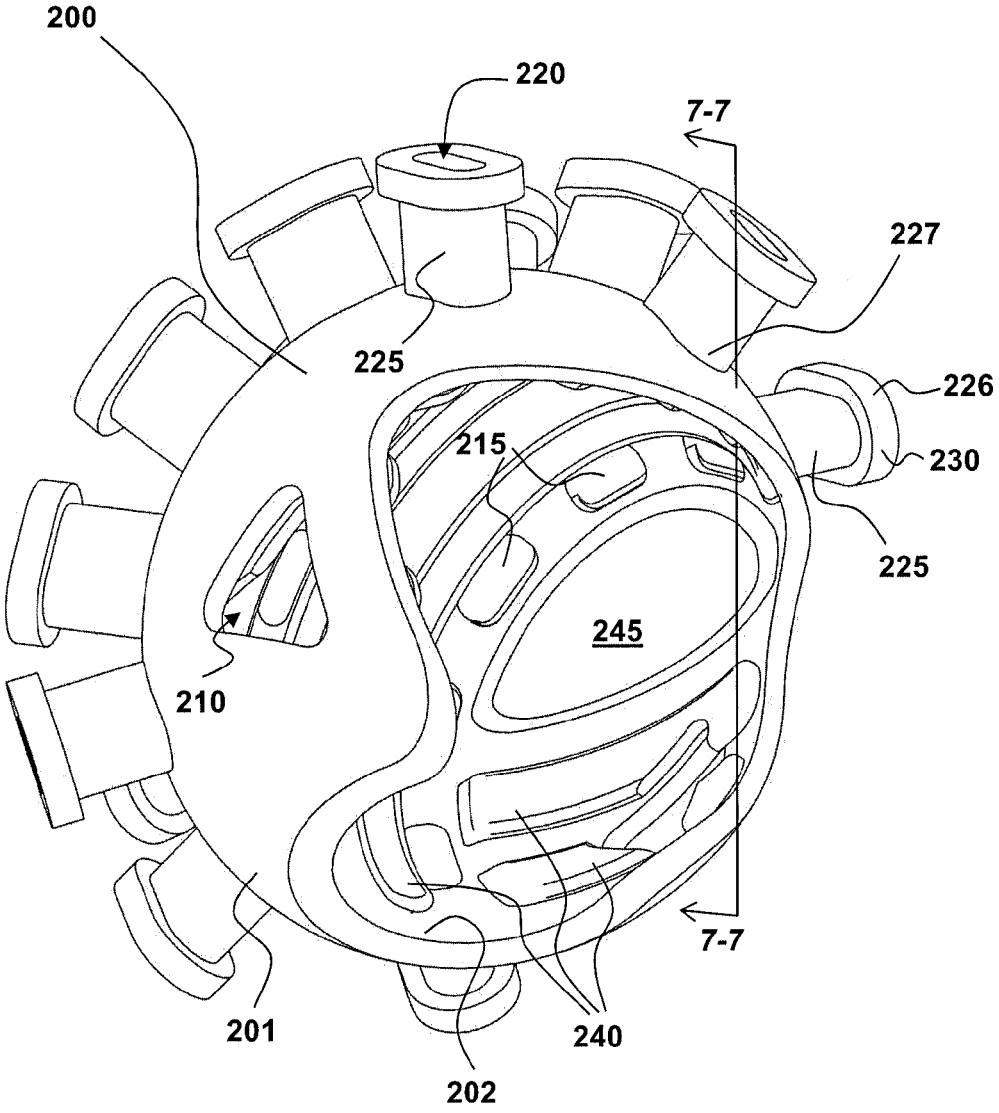
FIG. 6 is a perspective view of the liner portion of the embodiment shown in FIG. 1.

Reference is made to FIG. 1, which shows a perspective view of one embodiment of the helmet according to the present disclosure. Helmet 10 generally defines a headspace and comprises outer shell 20, liner portion 200, and first shock absorbing portion 100 disposed between the outer shell and the liner portion. As shown in FIG. 2, outer shell 20 comprises an outer surface 21 and an inner surface 22, and is generally adapted for receiving a head of a wearer. First shock absorbing portion 100 is disposed at or proximate inner surface 22 of outer shell 20. In addition, as shown in FIGS. 4 and 5, first shock absorbing portion 100 comprises an outer side 101 and an inner side 102, the inner side facing the head of the wearer. In at least one embodiment, first shock absorbing portion 100 extends to substantially surround the forehead, left side, right side, and rear regions of a head of a wearer. Liner portion 200 of the helmet is disposed at inner side 102 of first shock absorbing portion 100. Furthermore, liner portion 200 also has an outer side 201 and an inner side 202, as shown in FIG. 6. Thus the general structure and relative positioning of outer shell 20, first shock absorbing portion 100, and liner portion 200 in one embodiment of the present helmet is shown in FIG. 1.

Although the present disclosure is described with reference to helmet 10, the present disclosure also contemplates a helmet insert for use in combination with a helmet shell, the helmet insert comprising first shock absorbing portion 100 and liner portion 200.

First shock absorbing portion 100 can be made of any suitable material having suitable shock absorbing properties. For example, in at least one embodiment, first shock absorbing portion 100 will be made of or comprise a type of foam, including but not limited to an open-cell sponge foam. Furthermore, first shock absorbing portion 100 can be one or more of flexible, deformable, compressible, and capable of substantially recovering from a deformation. In addition, in at least one embodiment, first shock absorbing portion 100 will be made of or comprise a material or materials that have a substantially constant resistive deformation force characteristic. As described above, a constant force characteristic refers to the relatively constant resistive deformation force exhibited by the material during compression. Therefore the resistive deformation force does not significantly increase as the amount of deformation (e.g. compression) increases. Furthermore, in at least one embodiment, first shock absorbing portion 100 will be made of or comprise visco-elastic polyurethane foam, also known as "memory" foam. Some memory foams possess properties that make them useful in protective helmets. In particular, in certain instances memory foams are more effective than other types of foams or materials used in existing helmets to prevent or reduce the severity of concussions and spinal injuries resulting from a blow or other impact to the head. For example, some memory foams reduce the peak G-force on the head during an impact. One type of memory foam with desirable properties for use in a protective helmet is "Visco Elastic Foam 5010", made by Domfoam International of Quebec, Canada. This particular foam has a density of 4.5 to 5.0 pounds per cubic foot. However, other suitable types and makes of memory foam can also be used.

Certain types of memory foam, such as the 5010 foam mentioned above, have a non-linear compression response. In particular, such foam exhibits a somewhat constant force characteristic during a large portion of the work done as the foam compresses. This is a significant difference from other types of material, including some foams, that crush or compress where a more spring-like linear force is observed ($F=-k*x$) resulting in an undesirably high peak force. These other types of material generally result in a considerably higher peak force during an impact than the peak force of a material, such as certain kinds of memory foam, that exhibits a constant resistive deformation force to do the same work during compression.

Therefore in at least one embodiment of the present helmet or insert, a significant portion of the shock absorbing material in the helmet will be a shock absorbing portion having a relatively constant resistive deformation force characteristic. In addition, in at least one embodiment, a majority of the shock absorbing material in the helmet will be a shock absorbing portion having a relatively constant resistive deformation force characteristic. The shock absorbing portion having a relatively constant resistive deformation force characteristic can be in the form of memory foam. However, other materials having a relatively constant resistive deformation force characteristic can also be used.

In addition, the 5010 memory foam provides near identical performance during subsequent impacts. This is unlike other existing helmets that employ a shock absorbing material that does not substantially recover from a deformation, such as a crushable foam. An example of a crushable type foam is expanded poly-styrene (EPS). Such shock absorbing materials that do not substantially recover from a deformation, including crushable foams, are damaged during an impact and are therefore for a one major-impact use only. After an impact, the foam or other material must be replaced. However, the multiple impact property of the 5010 foam can avoid the need to service or discard the helmet after a first major impact. In addition, the use of multi-impact shock absorbing materials in a helmet avoids the situation where a person unknowingly uses a one major-impact use only helmet that has previously suffered a significant impact. Depending on the particular helmet, it can be difficult or almost impossible to visually recognize that a one major-impact use only helmet has suffered an impact and therefore should not be used. However, these problems do not arise with helmets having multiple impact shock absorbing materials, such as memory foam.

The 5010 memory foam and some other memory foams have desirable performance characteristics at room temperature (approximately 20 degrees C.), and even more desirable performance characteristics at temperatures below room temperature. These performance characteristics can be beneficial when the 5010 memory foam or some other memory foams are employed in a helmet or helmet insert that is used in cooler temperatures (e.g. below 20 C, and even temperatures below 0 degrees C.), for example for use in many winter sports.

In metallurgy, it is known that some metals have a positive thermal expansion coefficient and others have a negative thermal expansion coefficient. Alloys have been created to blend metals to create materials that are significantly invariant to expansion over widened temperature ranges. A common example known as "Invar" metal is a precise blend of nickel and iron. The 5010 memory foam has very good performance at room temperature and improved performance at lower temperatures. Similarly, it is expected that the physical properties of 5010 memory foam can be customized with blending into a specialized foam different from standard 5010 foam, that is optimized for the average temperature experienced by the foam in typical usage conditions for the type of helmet. Furthermore, like Invar metal, a temperature invariance may be possible, where those desirable physical properties that give these types of memory foam the flat line "constant force" characteristic may be kept relatively similar over a broader range of temperatures than the 5010 memory foam.

Figure 11:
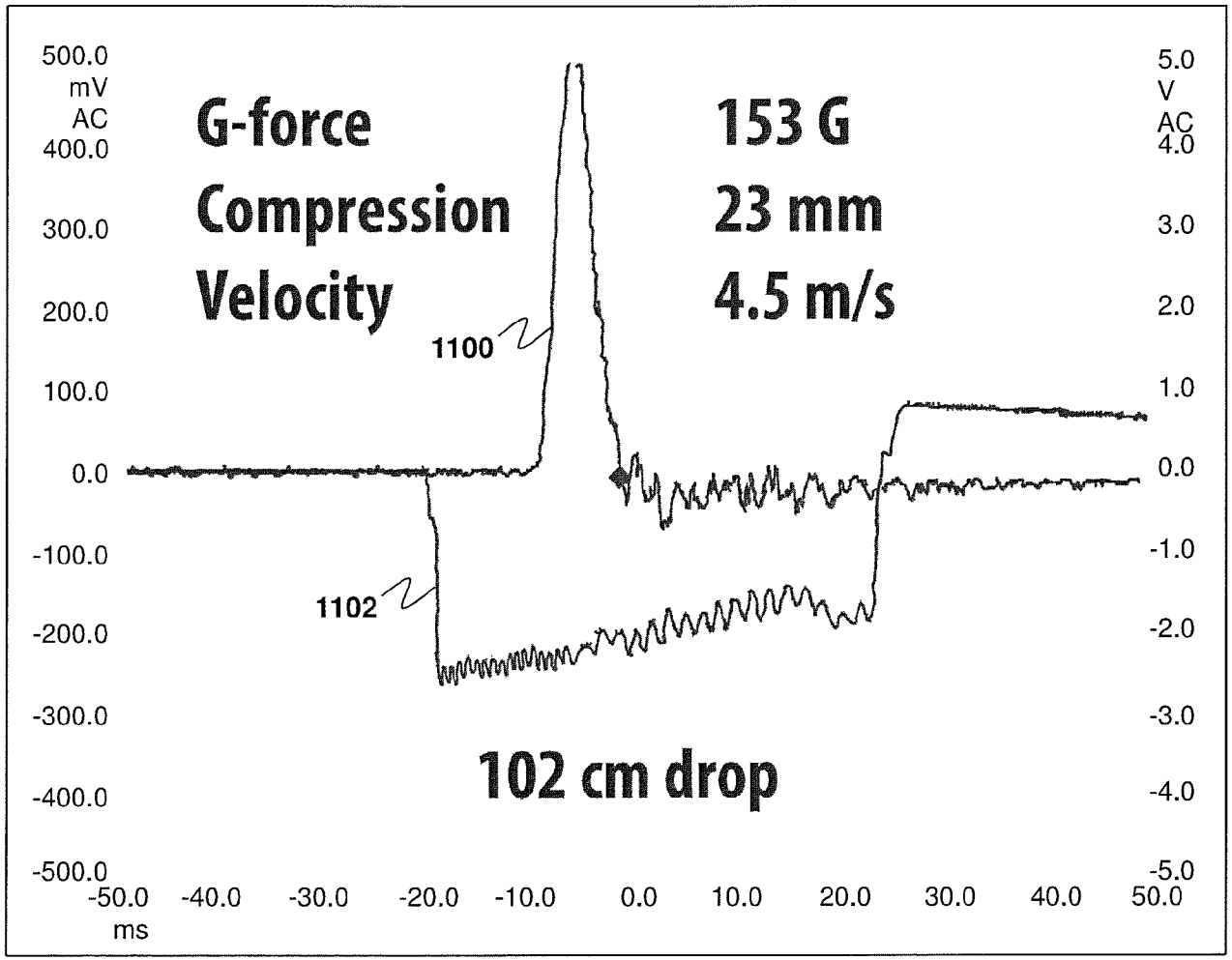
FIG. 11 is a graph showing G-force and compression measurements of an existing standard production helmet during a drop test.
Figure 12:
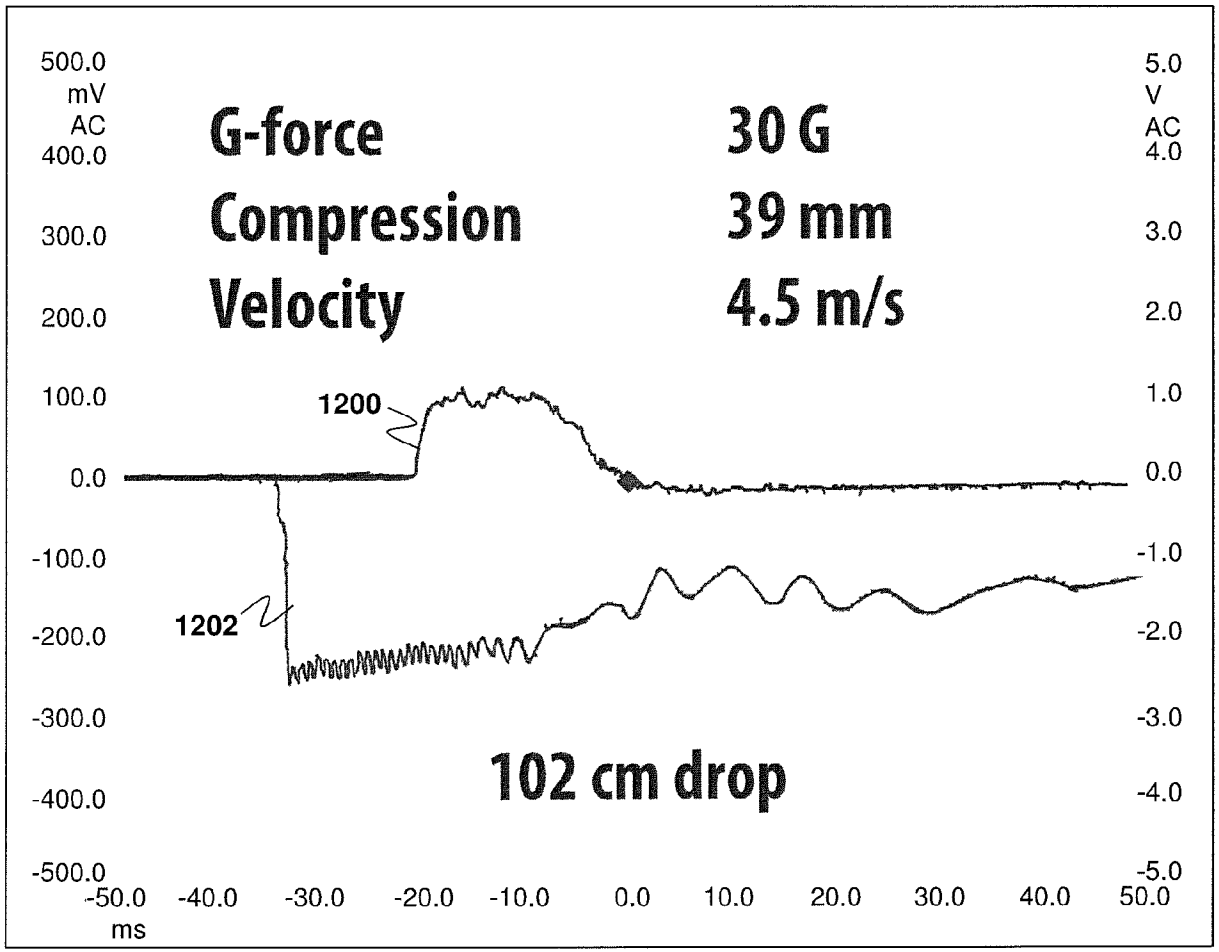
FIG. 12 is a graph showing G-force and compression measurements of a prototype testing helmet during a drop test.

FIGS. 11 and 12 show the results of two drop tests, one performed with an existing production hockey helmet, and the other performed with a prototype helmet according to the present disclosure.

FIG. 11 shows the results of a drop test performed with a model head of weight of approximately 10 lbs. onto a hard surface from a height of 1.02 meters using an existing production hockey helmet. The existing production helmet used in this test employed a different shock absorbing structure than the 2.0 inches of memory foam employed in the prototype helmet discussed in the following paragraph. The drop test was performed on the back of the helmet. A G-force sensor outputted 3.3 mV/G onto the vertical axis of the upper trace of a storage scope as a function of time in milliseconds on the horizontal axis. Even though the plot does not show above 500 mV, the peak measurement was made from the digital data on the storage scope. The lower trace was created by an alternating black and white pattern of period 3.25 mm passing by an optical sensor. By counting pulses from the moment G-force was detected to the end when helmet came to rest, an approximate measurement of compression was achieved. The velocity of 4.5 meters per second at impact point is a result of a drop from 1.02 meters. For the example production hockey helmet, a peak G-force of 153 G was measured from the upper trace and a compression distance of approximately 23 mm was measured from the lower trace in the head going from 4.5 m/s to stopped. The G-force measurements are indicated by line 1100, whereas the compression measurements are indicated by line 1102. Measurement accuracy for the G-force equipment was +/−4% and compression distance was +/−3.25 mm.

FIG. 12 shows the results of a drop test performed with a carbon fiber prototype helmet having a near-spherical shape. The outer shell of the prototype helmet is defined through a radius that varies from 5.5 inches on the sides to 6 inches on the back and top. The drop test conditions were the same as those in the drop test described above in relation to FIG. 11. In particular, both tests were performed using the same equipment and at the same ambient temperature. The foam stack-up at the back of the helmet was 0.4 inches of closed-cell foam, which includes spacing ribs, and 2.0 inches of 5010 memory foam. The memory foam was sandwiched between the outer shell and the closed-cell foam. It should be noted however that this prototype helmet did not comprise any vent shaft walls or other liner connectors interconnecting the liner (closed-cell foam) to the outer shell, or any vents. On the graph, the G-force measurements are indicated by line 1200, while the compression measurements are indicated by line 1202. During the drop test, a peak G-force of 30 G was measured from the upper trace and a compression distance of approximately 39 mm was measured from the lower trace in the head going from 4.5 m/s to stopped. Measurement accuracy for the G-force equipment was +/−4% and compression distance was +/−3.25 mm.

The test data shown in the graphs of FIGS. 11 and 12 show that the 5010 memory foam results in a much lower peak G-force to the head during an impact than the shock absorption materials used in the existing production hockey helmet. Again, the 5010 memory foam exhibits a significantly constant resistive deformation force characteristic. The test data also shows how using a foam of a greater thickness than the foams and other materials used in many existing helmets, including hockey helmets, can also reduce impact forces on the head.

Now turning back to the description of the helmet, first shock absorbing portion 100 can be of any suitable thicknesses at various regions in the helmet. The desired thickness can depend on the type or types of materials from which first shock absorbing portion 100 is made. For example, in embodiments employing the 5010 memory foam, it has been found that increasing the thickness of the foam generally results in lower peak G-forces to the head during an impact. However, it is usually necessary to strike a balance between the size and weight of a helmet, and the amount of protection that it provides. It has been determined that 5010 memory foam having a thickness of between 1.5 and 2 inches (38 mm to 51 mm) generally provides good (i.e. lower) peak G-forces to the head during an impact relative to many existing helmets. However, this thickness is not meant to be limiting. Other thickness may also be used. In at least one embodiment, first shock absorbing portion 100 will be of a thickness that is greater than the thickness of liner portion 200.

Furthermore, first shock absorbing portion 100 can have different thicknesses at different regions in the helmet. For example, in at least one embodiment, first shock absorbing portion 100 can be thicker in the rear region of the helmet, meaning the region that is in alignment with the back of a wearer's head. This increased thickness in the rear region can result in a lower peak G-force to the head when a wearer receives an impact at the back of the head, for example when the wearer falls backward and lands on the back of his or her head. In other embodiments, first shock absorbing portion 100 can have different thicknesses at other regions in the helmet.

Although first shock absorbing portion 100 is shown in the Figures as being a single piece, portion 100 may be comprised of multiple shock absorbing segments.

In addition, in at least one embodiment, as shown in the Figures, the helmet will comprise one or more vents for allowing fluid communication between the inner portion and the outer portion of the helmet. The one or more vents can allow hot air and perspiration from the wearer's head to escape, and also allow for cooler air to enter the helmet. In the embodiment shown in the Figures having outer shell 20, first shock absorbing portion 100, and liner portion 200, each of the three layers of the helmet has one or more aligned vents to allow for air flow between the inner and outer portions of the helmet.

Figure 3:
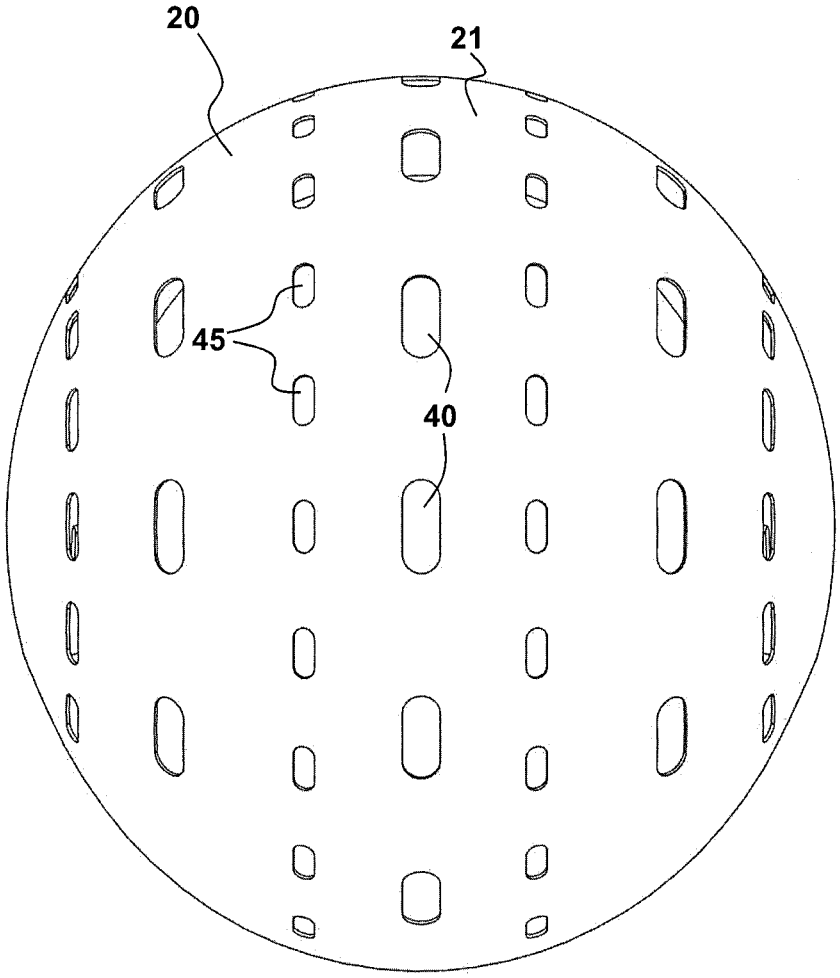
FIG. 3 is a top view of the outer shell of the embodiment shown in FIG. 1.
Figure 7:
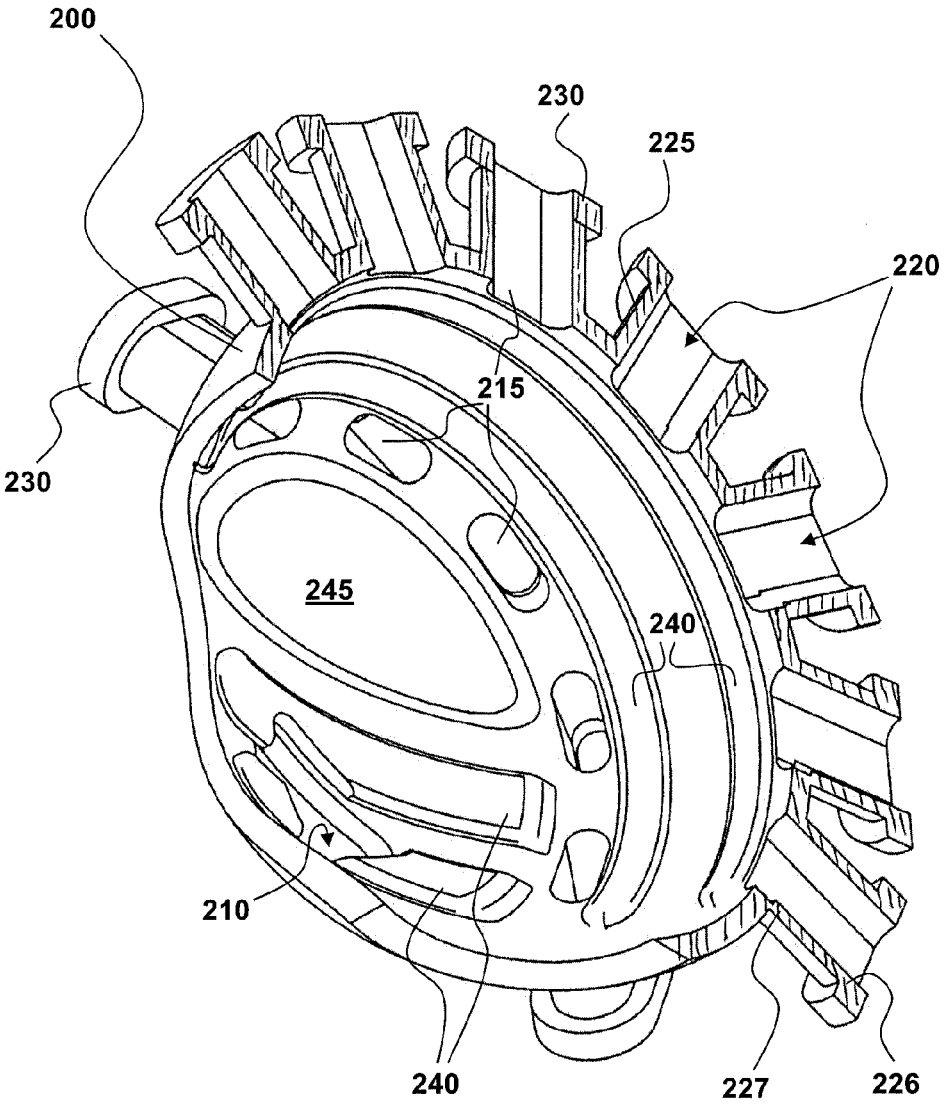
FIG. 7 is a cross sectional view of the liner portion taken along line 7-7 of FIG. 6.

For example, in at least one embodiment as shown in FIGS. 1 to 3, outer shell 20 can comprise one or more air vent holes 40. Furthermore, as shown in FIGS. 4 and 5, first shock absorbing portion 100 can define one or more spaced apart apertures or vents 110 therethrough. Apertures 110 extend from inner side 102 to outer side 101 of first shock absorbing portion 100. Although apertures 110 are shown in the Figures in the form of holes through a single shock absorbing portion 100, apertures 110 can be in the form of any void in shock absorbing portion region of the helmet. For example, apertures 110 can be in the form of other openings, or even gaps between adjacent shock absorbing segments where first shock absorbing portion comprises multiple segments. In addition, liner portion 200 can also comprise one or more vent holes or apertures 215, as shown in FIGS. 6 and 7. The one or more vent holes of the outer shell, the vents of the first shock absorbing portion, and the vents of the liner portion can be in substantial alignment to allow for fluid communication between the inner and outer portions of the helmet. The substantial alignment of the vents in the three layers of the helmet is shown in one embodiment in FIGS. 8 and 9.

The number, location, size, and shape of the various apertures and vents in each of the outer shell 20, first shock absorbing portion 100, and liner portion 200 shown in the Figures is not meant to be limiting. Rather, one or more of the number, location, size, and shape of the various apertures and vents can be suitably modified.

As described above, liner portion 200 can be disposed at inner side 102 of first shock absorbing portion 100. As shown in FIG. 1, in at least one embodiment, liner portion 200 can extend to cover substantially the entire inner side 102 of first shock absorbing portion 100. Liner portion 200 can be the part of the helmet that contacts or is otherwise in close proximity to the head of the wearer. In at least one embodiment, liner portion 200 can be made of a suitable material so that it acts as a thermal barrier between the wearer's head and the first shock absorbing portion 100. A thermal barrier may be appropriate where it is desirable to minimize or reduce the transfer of heat from the wearer's head to the first shock absorbing portion 100. For example, this can be desirable where the first shock absorbing portion 100 comprises memory foam, and the physical performance of the foam varies depending on the temperature of the foam. For example, the impact or compression performance of the foam may decrease as the temperature of the foam increases.

Furthermore, in at least one embodiment, liner portion 200 can be made of a material or materials that are fluid proof so that the liner portion acts as a fluid barrier between the wearer's head and first shock absorbing portion 100. This may be desirable depending on the material from which first shock absorbing portion 100 is made. For example, certain types of materials, including some types of foam, will suffer performance degradation when fluid or moisture penetrates the material. For example, if first shock absorbing portion 100 is made of memory foam, it will generally be desirable to provide a fluid proof barrier between the wearer's head and first shock absorbing portion 100 of the helmet so that any perspiration or other liquid does not penetrate the foam, thereby decreasing its performance during an impact.

In at least one embodiment, liner portion 200 can be made of or comprise closed-cell foam. In addition to being soft and thus providing a comfortable fit, closed-cell foam can provide a fluid proof barrier, and can also act as a thermal barrier, for example between the head and first shock absorbing portion 100. However, it is to be appreciated that liner portion 200 can be made of any other suitable material or materials including but not limited to foams, rubbers, silicon, and neoprene. For example, it has been found that low, medium, and high density marine grade seat cushion foams and floatation foams that exhibit suitable elastic qualities and that are not permeable to water are suitable. Foams may also be desirable as they can be relatively lightweight. Foam may also be a desirable material since it can also act as one or both of a thermal barrier and fluid barrier between the head of a wearer and first shock absorbing portion 100.

Liner portion 200 is shown in the Figures as a single piece. However, liner portion 200 can comprise multiple segments that together form the liner.

As shown in FIGS. 1, 6 and 7, liner portion 200 can comprise one or more spacing elements at its inner side 202. Spacer elements can be in the form of one or more support ribs 240 and support pads 245, and can be made of any suitable material, including the same material as the material from which liner portion 200 is made. The spacing elements can also be made of a soft material in order to provide a comfortable fit for the wearer. The spacer elements space liner portion 200 away from the wearer's head. This space or gap allows for the flow of warm air and moisture from the wearer's head out of the helmet via the one or more vents in the helmet. The spacing can also improve the effectiveness of the thermal barrier between the wearer's head and first shock absorbing portion 100. The one or more spacer elements can also contribute to an improved fit of the helmet to the head of a wearer.

Depending on the type or types of materials used for first shock absorbing portion 100, it may be desirable or even necessary to provide fluid sealing at first shock absorbing portion 100 to prevent the ingress of liquid or other fluid (e.g. sweat, water, etc.) into the shock absorbing portion. For example, certain types of foam will suffer performance degradation when fluid or moisture penetrates the foam. For example, this is the case with many open-celled foams as well as types of memory foams. Thus in the present helmet, when these types of foams are used in first shock absorbing portion 100, it can be desirable to provide fluid sealing at surfaces of first shock absorbing portion 100 that may be exposed to fluid.

In the embodiment shown in the Figures, one or more exposed surfaces of first shock absorbing portion 100 can be provided with fluid sealing to block the ingress of fluid into the foam of first shock absorbing portion 100. For example, the surface 112 of first shock absorbing portion 100 that defines each of the one or more vents 110 can be provided with fluid sealing. Surfaces 112 are indicated in FIGS. 4 and 5.

In addition, other exposed surfaces of first shock absorbing portion 100 can also comprise fluid sealing. As shown in FIGS. 1, 4 and 5, these other exposed surfaces include surface 103 in the face and neck regions of the helmet, and surfaces 106 in ear openings 105.

The fluid sealing can be in any suitable form, including but not limited to one or more layers of fluid-proof material. The fluid-proof material can be in the form of sheet material that is adhered to first shock absorbing portion 100. In such an embodiment, the sheet material can be flexible so that it can bend and deform as first shock absorbing portion 100 deforms. Another possibility is that the fluid-proof material can be sprayed onto the portion to create a fluid proof seal. Depending on the type or types of materials used for first shock absorbing portion 100, fluid sealing can also be achieved by melting or burning an exposed surface of first shock absorbing portion 100. Other ways of providing fluid sealing at exposed surfaces of first shock absorbing portion 100 are possible.

In at least one embodiment, as shown in FIGS. 6 to 9, fluid sealing at the surface 112 of each of the one or more vents 110 can be provided in the form of a vent shaft wall 225, which defines a vent shaft 220. Vent shaft wall 225 can be made of a fluid proof material and can serve as a liner for a vent or aperture 110 in first shock absorbing portion 100. Once helmet 10 or the helmet insert has been assembled, vent shaft wall 225 can be disposed within an aperture 110, and can extend from inner side 102 to outer side 101 of first shock absorbing portion 100. In this way, vent shaft wall 225 provides fluid sealing between vent shaft 220 and exposed surfaces 102 of first shock absorbing portion 100. Thus any moisture, rain, or other fluid disposed within or flowing through vent shaft 220 does not contact or penetrate an exposed surface of first shock absorbing portion 100.

Figure 8:
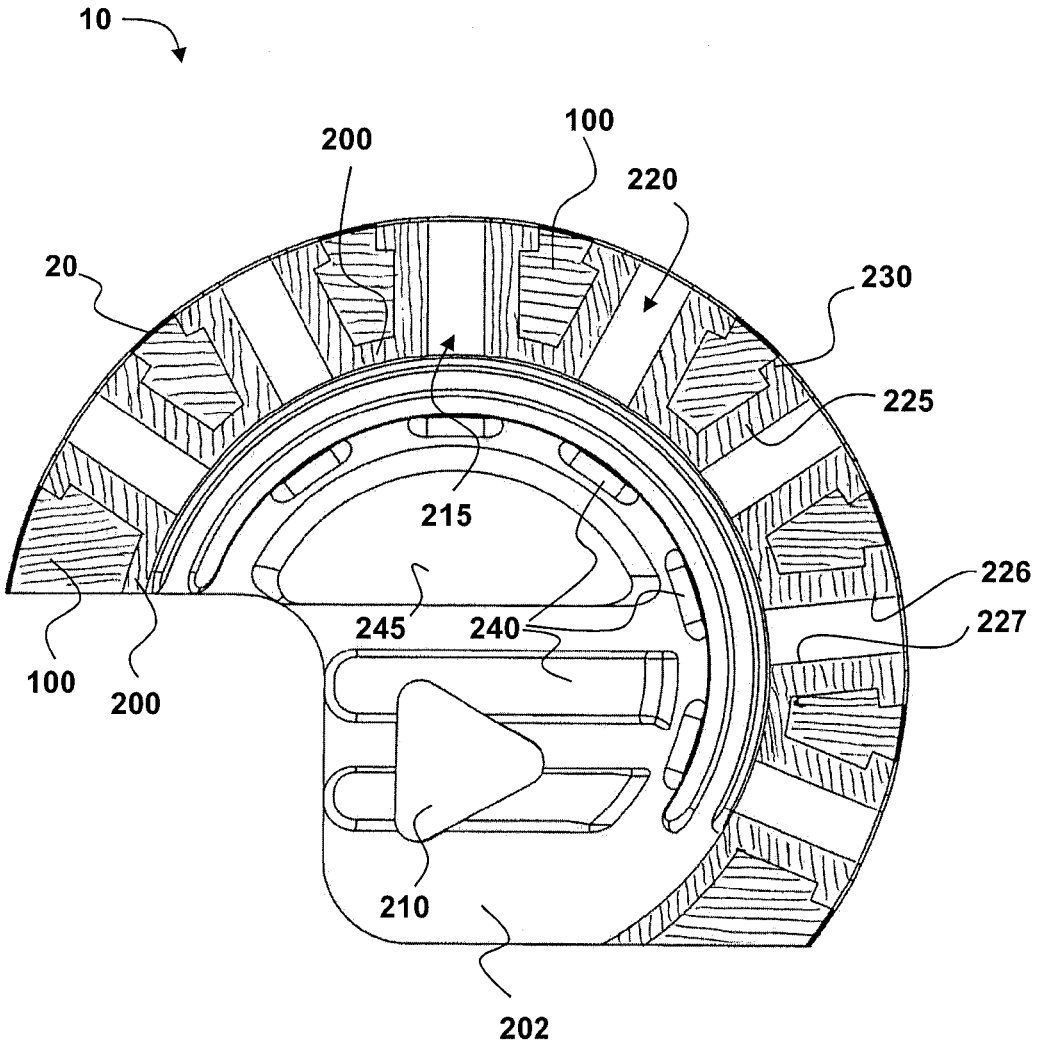
FIG. 8 is a cross sectional view of the helmet taken along line 8-8 of FIG. 1.
Figure 9:
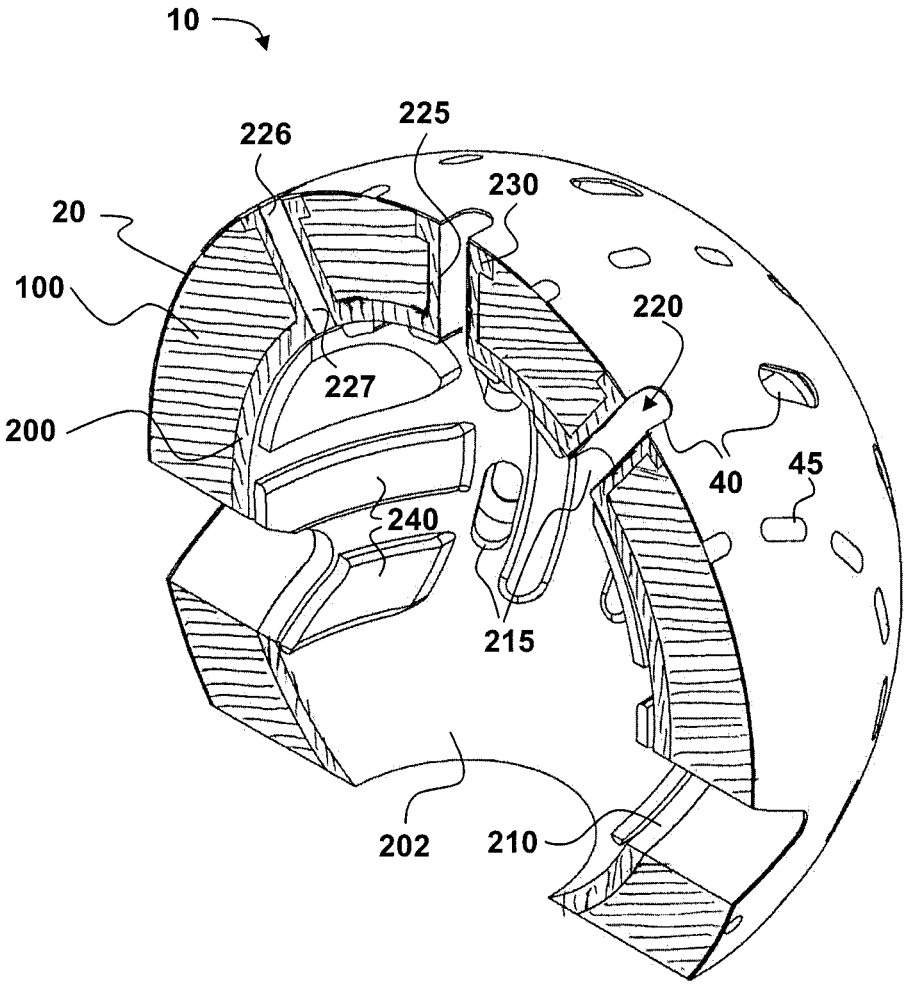
FIG. 9 is a cross sectional view of the helmet taken along line 9-9 of FIG. 1.

In addition, as shown in FIGS. 8 and 9, vent shaft wall 225 can extend between inner surface 22 of outer shell 20 and liner portion 200. Furthermore, distal end 226 of vent shaft wall 225 can be secured to inner surface 22, and proximal end 227 can be secured to liner portion 200. Distal and/or proximal ends 226 and 227 can be secured in any suitable way. For example, distal end 226 can be secured to the outer shell by way of adhesive, or by way of one or more hook and loop fasteners. Proximal end 227 can be secured to liner portion 200 using adhesive or any other suitable securing means. In at least one embodiment, one or more vent shaft walls 225 can be integrally formed with one or more other components of helmet 10, such as liner portion 200 and/or first shock absorbing portion 100. Regardless of whether vent shaft wall 225 is joined to or integrally formed with liner portion 200, vent shaft 220 defined by vent shaft wall 225 will be in fluid communication with a respective vent or aperture 215 in liner portion 200.

In addition, in at least one embodiment as shown in FIGS. 6 and 7, vent shaft wall 225 can comprise a flange 230 at its distal end 226. Flange 230 can facilitate and even strengthen the securing or attachment of distal end 226 to outer shell 20. For example, flange 230 can provide a larger surface area for receiving an adhesive, hook and loop fasteners, or other securing means. Flange 230 can be made of any suitable material, including the same material as the vent shaft wall 225.

The material from which vent shaft wall 225 is made can be flexible. In addition, this material can be resilient. In one or more embodiments where one or more vent shaft walls 225 are secured to both the outer shell 20 and to liner portion 200, the flexible vent shaft walls 225 can serve to moveably interconnect liner portion 200 to outer shell 20. This allows for limited movement of liner portion 200 relative to outer shell 20, which can be useful for absorbing energy during an impact to helmet 10. In this sense, vent shaft walls 225 serve as flexible liner connectors interconnecting outer shell 20 to liner portion 200. Furthermore, in at least one embodiment, one or more vent shaft walls 225 can be capable of collapsing or buckling after a certain amount of deformation or compression. If vent shaft wall 225 comprises a resilient material, then vent shaft wall 225 can return substantially to its pre-deformation shape following an impact. Thus in addition to the cushioning provided by first shock absorbing portion 100, vent shaft walls 225 can also absorb some of the energy of an impact as liner portion 200 is stretched, compressed, and/or rotated within outer shell 20 during an impact.

In at least one embodiment where first shock absorbing portion 100 and liner portion 200 are both flexible, an assembly operation will allow for insertion of all vent shaft walls 225 into apertures or vents 110 in first shock absorbing portion 100.

In at least one other embodiment, which is not shown in the Figures, the helmet can comprise one or more liner connectors for moveably interconnecting liner portion 200 with outer shell 20, thereby allowing for flexible and/or limited movement between the liner portion and the outer shell, for example during an impact. Although the embodiments described above include embodiments in which vent shaft walls 225 serve as liner connectors for moveably interconnecting liner portion 200 to outer shell 20, the present disclosure also contemplates that the liner connectors can take different forms from vent shaft walls 225. Thus much of the above description relating to vent shaft walls 225 also applies to the liner connectors.

These liner connectors can take any suitable form and can be made of any suitable material. For example, these materials include but are not limited to foams, plastics, and rubbers. Similar to some of vent shaft walls 225 described above, the liner connectors can be flexible and/or resilient. Thus in at least one embodiment, the liner connectors can absorb some of the energy of an impact as liner portion 200 is stretched, compressed, and/or rotated within outer shell 20 during a blow or other impact.

In addition, similar to vent shaft walls 225, the one or more liner connectors can extend through first shock absorbing portion 100 to interconnect liner portion 200 with outer shell 20. In at least one embodiment, the one or more liner connectors can extend through one or more apertures defined in first shock absorbing portion 100.

In at least one embodiment where a plurality of vent shaft walls 225 or liner connectors interconnect outer shell 20 to liner portion 200, first shock absorbing portion 100 and liner portion 200 can be retained within outer shell 20 by the plurality of vent shaft walls 225 or other liner connectors. In other words, the helmet does not necessarily require any addition connecting or fastening means for retaining first shock absorbing portion 100 and liner portion 200 in relative position within outer shell 20. However, in one or more other embodiments, helmet 10 and the helmet insert can comprise addition connecting or fastening means. For example, first shock absorbing portion 100 can be connected or fastened to outer shell 20 at one or more points using any suitable method, including but not limited to by way of hook and loop fasteners or adhesive. In addition, liner portion 200 can also be connected or fastened to first shock absorbing portion 100 at one or more points.

Turning now to outer shell 20, this component of the helmet can be made of any suitable material. Suitable materials include but are not limited to acrylonitrile butadiene styrene (ABS), polycarbonate, and carbon fiber. In at least one embodiment, outer shell will be substantially hard and rigid so that it suffers little or no deformation during an impact. Although not shown in the Figures, outer shell 20 can comprise one or more rigidifying elements disposed within the material of the shell or at the inner surface of the shell. These elements can reinforce the structure of outer shell 20 to reduce the amount of deformation of the shell during an impact, including the amount of deformation in the region of impact. The rigidifying elements can also reduce the likelihood of the shell fracturing or otherwise breaking during an impact.

In addition, outer surface 21 of outer shell 20 can be low friction so that an object impacting the shell will have greater tendency to slide and deflect off of the shell (or alternatively, the helmet will have a greater tendency to slide and deflect off of the object during an impact). This can result in a lower amount of force being transferred between the object and the helmet, and can also reduce the amount of rotational force applied to the helmet. The lowering of the amount of force being transferred to the helmet will possibly result in less severe injuries to the wearer of the helmet.

Furthermore, as shown in FIGS. 1 to 3 and 9, outer shell can comprise one or more holes or apertures 45, which can allow for evaporation of any liquid or moisture that ends up in first shock absorbing portion 100, or is otherwise disposed between first shock absorbing portion 100 and inner surface 22 of outer shell 20. However, holes or apertures 45 may not be suitable for certain uses of the helmet. For example, apertures 45 may be undesirable if the helmet is to be used in wet environments, such as outdoors when it rains, as apertures 45 will allow for the ingress of water into the helmet.

Figure 10:
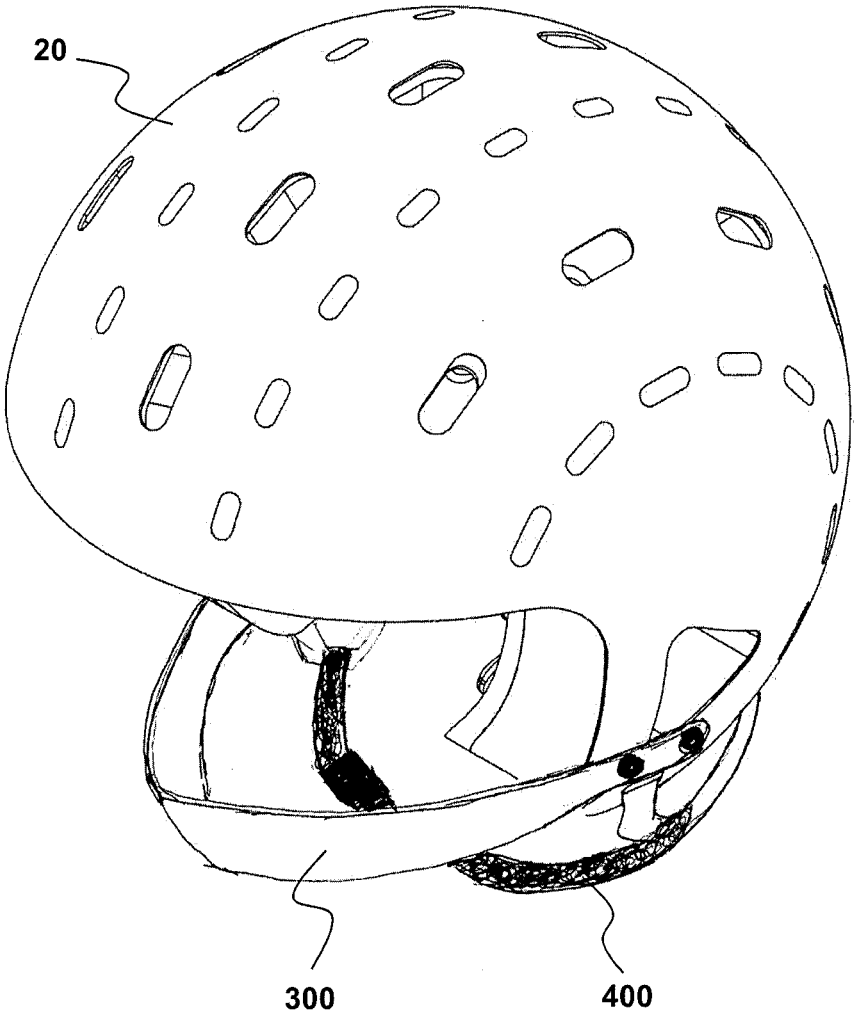
FIG. 10 is a perspective view of another embodiment of the helmet including a jaw guard and a chin strap.

In addition, outer shell 20 can also comprise a pair of ear openings 25. First shock absorbing portion 100 and liner portion 200 can also comprise ear openings 105 and 210, respectively, which are substantially aligned with openings 25 in the outer shell. Outer shell 20 can also comprise one or more holes 30 for receiving or otherwise connecting a chin strap to the helmet. Any type of suitable chin strap can be used with the present helmet. One embodiment of helmet 10 having a chin strap 400 is shown in FIG. 10, the chin strap being connected to outer shell 20 by way of holes 30 in the shell.

In at least one embodiment having flexible and resilient liner connectors, which can be in the form of vent shaft walls, the resilient nature of the liner connectors can allow for connector stretching, compressing, and possibly folding or buckling, to keep the helmet structure intact during compression. In addition, liner portion 200 similarly can be capable of stretching, compressing, or otherwise deforming.

In addition, in at least one embodiment, the majority of the shock and impact absorption work can be done by first shock absorbing portion 100 as portion 100 compresses and deforms. Vent shaft walls 225 or other liner connectors, along with liner portion 200, can also distort or deform during an impact due to their flexible nature. For example, during an impact, the head of a wearer will move closer towards outer shell 20 at the point of impact. In effect, first shock absorbing portion 100 will be compressed and sandwiched between liner portion 200 and outer shell 20. In addition to shock absorbing portion 100, one or both of liner portion 200 and vent shaft walls 225 or other liner connectors can also absorb energy of an impact. However, in at least one embodiment, the majority of the shock and impact absorption work done by the helmet or helmet insert can be done by first shock absorbing portion 100. In other words, first shock absorbing portion 100 will absorb the majority of the energy that is absorbed by the helmet during an impact. On the other hand, outer shell 20 can contribute very little to absorbing the energy of an impact. In at least one embodiment, outer shell 20 will undergo little or no deformation during impact.

Furthermore, outer shell 20 can have a continuously curved outer surface 21. In at least one embodiment, as shown in the Figures, outer surface 21 of outer shell 20 can have a substantially spherical or spherical-like shape. This provides advantages over many existing helmets, some of which have somewhat irregular shapes, and others that comprise ridges, protrusions, seams, and other non-continuous or non-smooth surfaces on their outer surface. For example, an object impacting a shell having a substantially spherical or spherical-like shape will have greater tendency to slide and deflect off of the shell (or alternatively, the helmet will have a greater tendency to slide and deflect off of the object during an impact) compared to shells having other shapes. This can result in a lower amount of force being transferred between the object and the helmet, and can also reduce the amount of rotational force applied to the helmet. The lowering of the amount of force being transferred to the helmet will possibly result in less severe injuries to the wearer of the helmet.

In one or more embodiments of the present helmet, outer shell 20 of the helmet is not rigidly coupled to the head of a wearer, but rather is retained in stable alignment with the head through at least first shock absorbing portion 100, liner portion 200, and possibly a chin strap, until such time as a linear or rotational force is applied to outer shell 20 (e.g. during an impact). When a linear or rotational force is applied to outer shell 20, one or more of the internal components of the helmet can allow for the movement, including rotation, of outer shell 20 relative to the head. Thus in this sense, outer shell 20 is moveably interconnected to the head rather than being rigidly coupled to the head. Therefore during an impact, some of the linear and/or rotational forces applied to outer shell 20 can be absorbed by the helmet as the outer shell moves and/or rotates relative to the liner or head of the wearer. The ability of the shell to rotate relative the liner or head during an impact can be provided by the flexibility or give of one or more of first shock absorbing portion 100, liner portion 200, and vent shaft walls 225 or other liner connectors.

One or more options for fitting the present helmet to the head of a wearer are now described. One fitting option is to loosely fit the helmet to the head of a wearer so that the helmet does not firmly grip the head. The helmet can be retained in position on the head by way of a chin strap and/or one or more spacing elements, such as support ribs 240 and support pads 245, disposed at inner side 202 of liner portion 200. A loose fit of the helmet on the head of a wearer can possibly result in reduced injuries to the wearer as a result of forces applied to the helmet that cause the helmet to rotate during impact. Because the helmet fits loosely on the head, the entire helmet can rotate to some degree about the wearer's head during an impact. Accordingly, at least some of the rotation of the helmet caused during an impact is not transferred to the wearer's head. However, the term "loose" does not suggest that the helmet is so loose that it can flop about on the head of a wearer. Rather, "loose" refers to outer shell 20 not being rigidly coupled to the head during substantial impacts that apply significant linear or rotational forces on outer shell 20. In at least one embodiment, rigid coupling of the outer shell to the head is avoided by means of the flexible nature of first shock absorbing portion 100 and liner portion 200. By nature of the design with the liner, vent shaft walls or liner connectors, and the chin strap, in normal use prior to a significant impact event, outer shell 20 will stay properly aligned on the head.

The various components of the helmet can provide for a secure and stable fitting of the helmet onto the head of a wearer. For example, liner portion 200, as well as any spacing elements such as support ribs 240 and/or support pads 245, can contact the head to position and retain the helmet in the desired position and orientation on the head. The use of a suitable chin strap can also assist in retaining the helmet on the head of a wearer. It will often be desirable for the helmet to be retained and properly orientated on the head during normal use. However, it can be acceptable if not desirable in some circumstances for the helmet to move relative the head (e.g. rotate) during an impact. This movement of the helmet is distinct from any rotation of outer shell 20 relative to liner portion 200 described above. As previously mentioned, a portion of the energy of an impact can be dissipated as the helmet rotates or otherwise moves relative to the head of the wearer. This can be more desirable than having the full force and energy of an impact transmitted to the head of the wearer. Following an impact, a wearer can simply reposition the helmet on their head if the wearer wishes to continue his or her activity.

Furthermore, in at least one embodiment as shown in FIG. 10, the helmet can comprise a jaw guard 300. Jaw guard 300 can be shaped to extend generally from helmet and around the jaw region of a wearer of the helmet. The jaw guard can thus transfer and spread at least part of a force directed to the jaw region of the head to the structure of the helmet instead of to the jaw. Jaw guard 300 therefore transmits at least part of a force imparted on the guard to the rest of the helmet. The guard can be connected or fastened to helmet 10 in any suitable way, including by way of mounting holes 35 in outer shell 20. In addition, jaw guard 300 can have a curvature that is generally consistent with the curvature of the helmet. For example, where outer shell 20 of the helmet has a spherical or spherical-like shape, jaw guard 300 can also have a similar curvature. A jaw guard having such a shape can provide similar advantages as those described above in relation to the spherical or spherical-like shaped outer shell 20. For example, jaw guard 300 having a spherical or spherical-like shape can result in an increase in glancing blows rather than direct impact blows. In addition, jaw guard 300 having a spherical or spherical-like shape can result in a force vector that is directed towards the center of the head space of the helmet rather than transforming a blow into a rotational force on outer shell 20. In addition to spherical or spherical-like shapes, jaw guard 300 can also have other continuous curvatures that will provide for results that are similar to those discussed above.

The embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

Moreover, the previous detailed description is provided to enable any person skilled in the art to make or use the present invention. Various modifications to those embodiments will be readily apparent to those skilled in the art, and the generic principles defined herein may be applied to other embodiments without departing from the spirit or scope of the invention described herein. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed:

1. A helmet insert disposable at an inner side of a shell of a helmet, the insert comprising:

a first resilient shock absorbing portion comprising material possessing a substantially constant resistive deformation force characteristic whereby the material exhibits a substantially constant resistive deformation force during compression of the material during an impact, the material consisting essentially of open-cell foam, the first shock absorbing portion having an outer side and an inner side;

a flexible liner portion, the liner portion being disposed at or proximate the first shock absorbing portion, the liner portion having an outer side and an inner side; and wherein the inner side of the first shock absorbing portion faces the outer side of the flexible liner portion;

wherein the helmet insert defines at least one aperture therethrough extending between the inner side of the liner portion and the outer side of the first shock absorbing portion for providing fluid communication between the inner side of the liner portion and the outer side of the first shock absorbing portion;

wherein the helmet insert further comprises fluid sealing for preventing the ingress into the first shock absorbing portion of any fluid disposed in or flowing through the at least one aperture;

wherein the fluid sealing is in the form of one or more vent shaft walls, each vent shaft wall defining a vent shaft therethrough, and being disposed in a one of at least one aperture in the first shock absorbing portion and extending between the inner side and the outer side of the first shock absorbing portion; and wherein when the insert is disposed in the helmet, the first shock absorbing portion faces an inner surface of the shell, and the liner portion faces a region of the helmet adapted to receive the head of a wearer.

2. The helmet insert of claim 1 wherein the first shock absorbing portion is in the form of visco-elastic polyurethane foam.

3. The helmet insert of claim 1 wherein the liner portion is in the form of closed-cell foam.

4. The helmet insert of claim 1 wherein the first shock absorbing portion has a thickness of at least 1.5 inches, and wherein the liner portion has a thickness that is less than a thickness of the first shock absorbing portion.

5. The helmet insert of claim 1 wherein the liner portion is a waterproof barrier.

6. The helmet insert of claim 1 wherein when the helmet insert is positioned on the head of a wearer, the first shock absorbing portion extends to substantially surround the forehead, left side, right side, and rear regions of the head.

7. The helmet insert of claim 1 wherein a proximal end of the one or more vent shaft walls is connected to the liner portion.

8. The helmet insert of claim 7 wherein the one or more vent shaft walls are resilient.

9. The helmet insert of claim 7 wherein the one or more vent shaft walls are resilient, and wherein a distal end of the one or more vent shaft walls extends from the liner portion towards the outer side of the first shock absorbing portion.

10. The helmet insert of claim 9 wherein the distal end of the one or more vent shaft walls comprises a flange.

11. The helmet insert of claim 9 wherein when the helmet insert is disposed within the shell, the one or more vent shaft walls are aligned with one or more apertures in the shell.

12. A helmet insert for a helmet, the insert comprising:

a first resilient shock absorbing portion having an outer side and an inner side;

a flexible liner portion, the liner portion being disposed at or proximate the inner side of the first shock absorbing portion;

a plurality of spaced apart resilient liner connectors having a tubular shape and comprised of closed cell foam, each liner connector comprising a proximal end connected to the liner portion, each liner connector further comprising a distal end extending towards the outer side of the first shock absorbing portion, each liner connector further comprising an aperture extending from the distal end to the proximal end.

13. The helmet insert of claim 12 wherein the first shock absorbing portion comprises material possessing a substantially constant resistive deformation force characteristic whereby the material exhibits a substantially constant resistive deformation force during compression of the material during an impact.

14. The helmet insert of claim 13 wherein the first shock absorbing portion has a thickness of at least 1.5 inches.

15. The helmet insert of claim 13 wherein the material comprises visco-elastic polyurethane foam.

* * * * *